US010493772B2

(12) United States Patent
Yonemitsu et al.

(10) Patent No.: US 10,493,772 B2
(45) Date of Patent: Dec. 3, 2019

(54) THERMAL TRANSFER METHOD AND THERMAL TRANSFER APPARATUS

(71) Applicant: G-Printec, Inc, Kawasaki-shi, Kanagawa (JP)

(72) Inventors: Satoshi Yonemitsu, Kawasaki (JP); Seiichi Tanabe, Kawasaki (JP); Osamu Goto, Kawasaki (JP)

(73) Assignee: G-PRINTEC, INC., Kawasaki-Shi, Kanagawa (JP)

( * ) Notice: Subject to any disclaimer, the term of this patent is extended or adjusted under 35 U.S.C. 154(b) by 0 days.

(21) Appl. No.: 16/134,518

(22) Filed: Sep. 18, 2018

(65) Prior Publication Data

US 2019/0160830 A1 May 30, 2019

(30) Foreign Application Priority Data

Nov. 29, 2017 (JP) ..... 2017-228606

(51) Int. Cl.
*B41J 2/045* (2006.01)
*B41J 2/325* (2006.01)

(52) U.S. Cl.
CPC ..... *B41J 2/325* (2013.01)

(58) Field of Classification Search
CPC .. B41F 16/00; B41F 16/0006; B41F 16/0026; B41F 16/0033; B41J 2/315; B41J 2/32; B41J 2/325
See application file for complete search history.

(56) References Cited

U.S. PATENT DOCUMENTS

2009/0165934 A1* 7/2009 Koike ..... B41M 7/0027 156/182
2011/0074904 A1* 3/2011 Marcus ..... B41J 17/38 347/218
2015/0002602 A1* 1/2015 Hashimoto ..... B41J 2/325 347/214

FOREIGN PATENT DOCUMENTS

JP 201322797 A 2/2013
JP 2004330782 A 11/2014

* cited by examiner

*Primary Examiner* — Kristal Feggins
(74) *Attorney, Agent, or Firm* — Nath, Goldberg & Meyer; Jerald L. Meyer

(57) ABSTRACT

A superimposed transfer target film and ink ribbon is moved while being sandwiched by a thermal head and a platen roller, and during execution of a thermal transfer of thermally transferring ink of the ink ribbon to a transfer layer of the transfer target film by heat of the thermal head, the transfer target film is pulled and moved while leaving a sticking portion in which the ink ribbon sticks to the transfer target film by the heat. After the thermal transfer is ended, the transfer target film stops being moved, is enabled to be loosened, and a downstream portion of the ink ribbon is wound up and stretched while leaving the sticking portion sticking to the transfer target film. While leaving the downstream portion of the ink ribbon stretched, a downstream portion of the transfer target film is wound up, and the sticking portion is peeled.

5 Claims, 11 Drawing Sheets

THERMAL TRANSFER METHOD AND THERMAL TRANSFER APPARATUS

CROSS REFERENCE TO RELATED APPLICATION

This application is based upon and claims the benefit of priority under 35 U.S.C. § 119 from Japanese Patent Application No. 2017-228606 filed on Nov. 29, 2017, the entire contents of which are incorporated herein by reference.

BACKGROUND

The present disclosure relates to a thermal transfer method and a thermal transfer apparatus.

Japanese Unexamined Patent Application Publication No. 2013-22797 (Patent Literature 1) describes a thermal transfer apparatus that superimposes an ink ribbon and a transfer target film on each other, passes these between a thermal head and a platen roller pressing the thermal head and rotating, transfers ink of the ink ribbon to an ink transfer layer of the transfer target film by heat of the thermal head, and forms a transfer image.

Such a thermal transfer printing apparatus described in Patent Literature 1 is provided with a structure in which a peeling roller is provided downstream from the thermal head and the platen roller in a conveying direction in order to peel off the ink ribbon and the transfer target film, which stick to each other due to the thermal transfer, from each other, and then with respect to the transfer target film conveyed in a thermal transfer operation, a conveying direction of the ink ribbon is deflected at a predetermined angle on and after the peeling roller.

Japanese Unexamined Patent Application Publication No. 2004-330782 (Patent Literature 2) describes a retransfer-system thermal transfer apparatus that transfers a transfer image, which is formed on a transfer target film, again to a retransfer target member such as a card, and forms a retransfer image.

For example, when the retransfer target member is a card, it is necessary that a region in which a sign is written or a region to be provided with an electric contact to be connected to a built-in integrated circuit (IC) be defined as non-retransfer regions for which the transfer image is not retransferred.

Patent Literature 2 describes that, in order to form such a non-retransfer region in the retransfer target member, a peeling function layer that adheres to the ink transfer layer of the transfer target film by heat pressing is provided in advance in the ink ribbon, and an ink transfer layer of the transfer target film, which corresponds to the peeling function layer, is partially peeled off by performing the thermal transfer operation.

SUMMARY

Incidentally, in the conventional thermal transfer apparatus described in Patent Literature 1, in some cases, both of the transfer target film and the ink ribbon are not actually peeled off from each other at the position of the peeling roller, but are peeled off at a downstream position where a peeling angle is larger due to variations in sticking strength between both of the target transfer film and the ink ribbon. That is, the peeling position may vary in some cases.

By such variation in the peeling position, tension of each of the transfer target film and the ink ribbon also varies. If the tension of the transfer target film varies during execution of the transfer, then such malfunctions that a transfer position deviates and that a lateral stripe pattern appears on a transfer image occur in the transfer to the transfer target film. Moreover, in the peeling of the ink transfer layer in Patent Literature 2, another malfunction occurs that a peeling position of the ink transfer layer deviates.

In either of the cases, when excessive tension occurs, a malfunction that the ink ribbon is broken can occur. Therefore, it is desired that no malfunction occur in such an operation of peeling the transfer target film and the ink ribbon from each other.

It is an object of one or more embodiments to provide a thermal transfer method and a thermal transfer apparatus, which are capable of peeling the ink ribbon and the transfer target film from each other without any malfunction.

A first aspect of one or more embodiments provides a thermal transfer method including: moving a superimposed transfer target film and ink ribbon while sandwiching the transfer target film and the ink ribbon by a thermal head and a platen roller, and during execution of a thermal transfer of thermally transferring ink of the ink ribbon to a transfer layer of the transfer target film by heat of the thermal head, pulling and moving the transfer target film while leaving a sticking portion in which the ink ribbon sticks to the transfer target film by the heat; after the thermal transfer is ended, stopping moving the transfer target film and enabling the transfer target film to be loosened, winding up and stretching a downstream portion of the ink ribbon from the thermal head while leaving the sticking portion sticking to the transfer target film; and while leaving the downstream portion of the ink ribbon stretched, winding up a downstream portion of the transfer target film from the thermal head, and peeling the sticking portion.

A second aspect of one or more embodiments provides a thermal transfer apparatus including: a thermal head and a platen roller which leave and contact relatively each other by operations of a driver; a first motor and a second motor for winding up respectively a transfer target film and an ink ribbon, the transfer target film and the ink ribbon being hung over to be directly opposed to each other between the thermal head and the platen roller; and a controller for controlling operations of the driver and the first and second motors, and executing a thermal transfer operation of thermally transferring ink of the ink ribbon to a transfer layer of the transfer target film by heat of the thermal head.

The controller performs control: while operating the driver and sandwiching the transfer target film and the ink ribbon between the thermal head and the platen roller, to drive the first motor, to wind up the transfer target film while causing the ink ribbon to follow the transfer target film in a state of being provided with a sticking portion in which the ink ribbon sticks by heat, after the thermal transfer, to operate the second motor, to cause a downstream portion of the ink ribbon from the thermal head to follow the transfer target film sticking to the ink ribbon at the sticking portion, and to stretch the downstream portion of the ink ribbon; and thereafter, while leaving the ink ribbon stretched, to drive the first motor to wind up a downstream portion of the transfer target film from the thermal head, and to peel the sticking portion.

DETAILED DESCRIPTION

A thermal transfer apparatus according to one or more embodiments will be described by a thermal transfer apparatus 51 of an example. The thermal transfer apparatus 51 is an apparatus that thermally transfers ink of an ink ribbon 2 to a transfer target film 1 and forms a transfer image.

Figure 1:
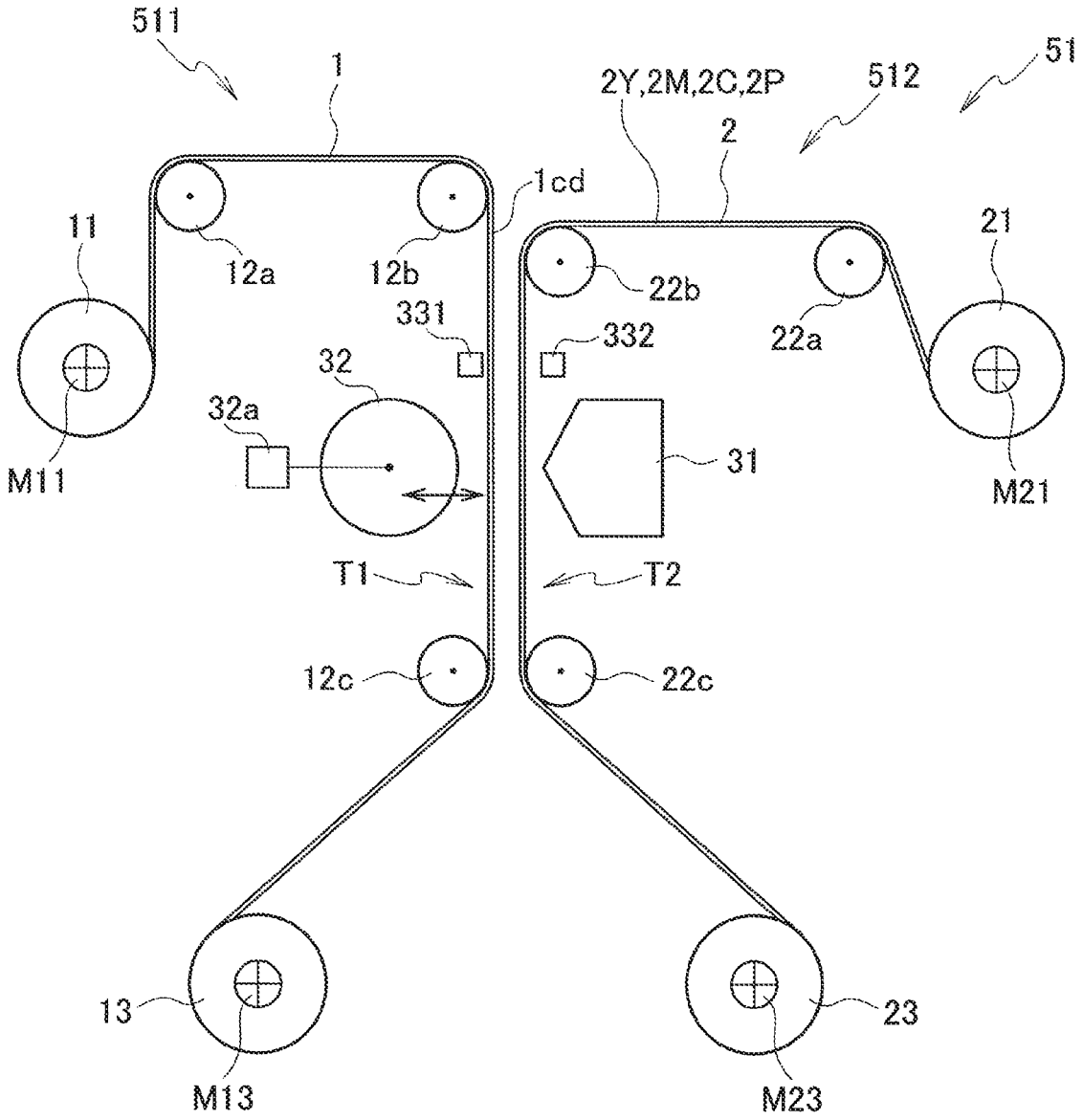
FIG. 1 is a schematic diagram illustrating a configuration of a thermal transfer apparatus 51 as an example of a thermal transfer apparatus according to one or more embodiments.

FIG. 1 is a schematic diagram illustrating a configuration of the thermal transfer apparatus 51. On the left side in FIG. 1, a film conveying system 511 as a conveying system for the transfer target film 1 is disposed. On the right side in FIG. 1, a ribbon conveying system 512 as a conveying system for the ink ribbon 2 is disposed.

Figure 2A:
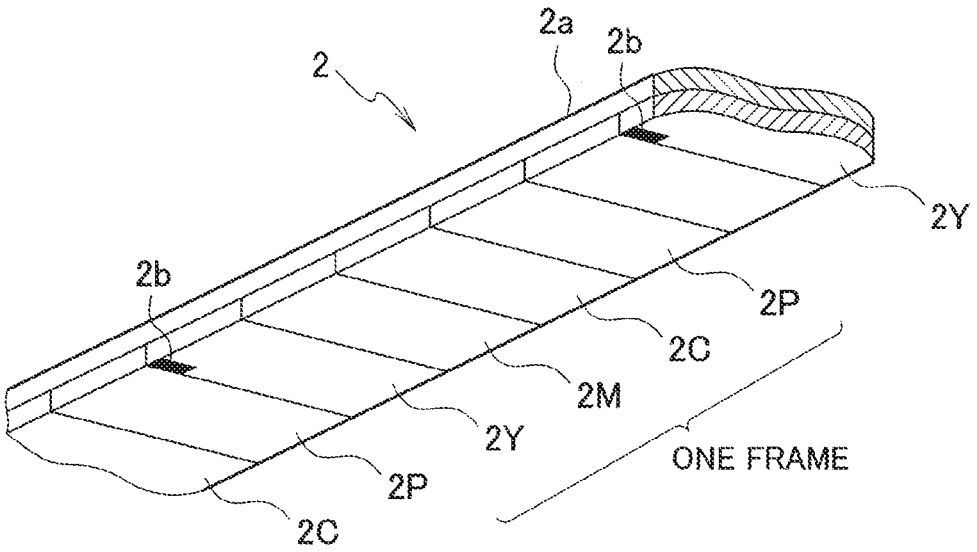
FIG. 2A is a partial perspective view illustrating an ink ribbon 2 for use in the thermal transfer apparatus 51.
Figure 2B:
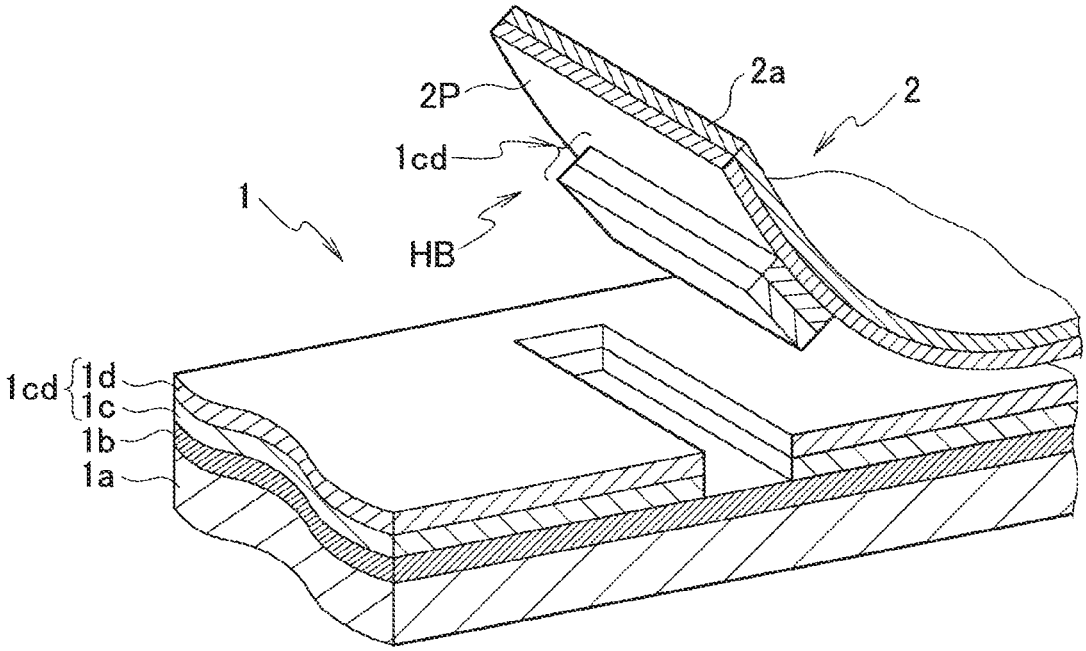
FIG. 2B is a partial perspective view illustrating a transfer target film 1 for use in the thermal transfer apparatus 51.

As illustrated in FIG. 2B, the transfer target film 1 is formed in such a manner that a peel layer 1*b*, a protection layer 1*c*, and an ink receptive layer 1*d* are stacked in this order on one surface of a band-like base film 1*a*. Among them, the protection layer 1*c* and the ink receptive layer 1*d* serve as a transfer layer 1*cd*. Typically, the thickness of the transfer target film 1 is approximately 20 μm.

On the transfer target film 1, markers (not illustrated) capable of detecting light are formed at a predetermined pitch in a longitudinal direction (in the conveying direction of the transfer target film 1). A region between the markers on the transfer layer 1*cd* serves as a region for one frame that will be described later in detail.

As shown in FIG. 2A, the ink ribbon 2 is formed in such a manner that ink layers and a peel function layer are periodically applied on one surface of a band-like base sheet 2*a*.

Specifically, a set composed of three-color fusion or sublimation ink layers which are a yellow ink layer 2Y, a magenta ink layer 2M, and a cyan ink layer 2*c*, and of a peel function layer 2P, is defined as one frame. Then, this one frame is periodically applied to one surface of the base sheet 2*a*. In this way, the ink ribbon 2 is formed.

The peel function layer 2P is a layer to be adhered to the transfer layer 1*cd* of the transfer target film 1 by heating. Typically, a thickness of the ink ribbon 2 is 10 μm or less.

Moreover, markers 2*b*, detectable by an optical sensor, are added to every frame to the ink ribbon 2.

Returning to FIG. 1, the film conveying system 511 includes: a feeding reel 11 for the transfer target film 1; a motor M11 for rotating the feeding reel 11 positively and reversely; guide rollers 12*a*, 12*b*, and 12*c* for guiding the transfer target film 1, which is fed from the feeding reel 11, so that the transfer target film 1 is conveyed through a predetermined path; a winding reel 13 for winding up the transfer target film 1 guided and conveyed by the guide rollers 12*a* to 12*c*; and a motor M13 for rotating the winding reel 13 positively and reversely.

The ribbon conveying system 512 includes: a feeding reel 21 for the ink ribbon 2; a motor M21 for rotating the feeding reel 21 positively and reversely; guide rollers 22*a*, 22*b*, and 22*c* for guiding the ink ribbon 2, which is fed from the feeding reel 21, so that the ink ribbon 2 is conveyed through a predetermined path; a winding reel 23 for winding up the ink ribbon 2 guided and conveyed by the guide rollers 22*a* to 22*c*; and a motor M23 for rotating the winding reel 23 positively and reversely.

As illustrated in FIG. 1, a transfer area T1 that is a portion of the transfer target film 1 between the guide roller 12*b* and the guide roller 12*c*, and a transfer area T2 that is a portion of the ink ribbon 2 between the guide roller 22*b* and the guide roller 22*c* are configured to come close to and be opposed to each other.

In the film conveying system 511, the transfer target film 1 is hung over so that the transfer layer 1*cd* faces the outside.

In the ribbon conveying system 512, the ink ribbon 2 is hung over so that the ink regions (2Y, 2M, and 2C) and the peel function layer 2P face to the outside.

Hence, in the transfer area T1 and the transfer area T2, the transfer layer 1*cd* is directly opposed to the ink regions (2Y, 2M, and 2C) and the peel function layer 2P.

In the ribbon conveying system 512, a thermal head 31 is disposed at a position corresponding to the transfer area T2.

In the film conveying system 511, at a position corresponding to the thermal head 31 in the transfer area T1, a platen roller 32 is disposed so as to sandwich the transfer target film 1 and the ink ribbon 2, which are thus hung over, between the thermal head 31 and the platen roller 32 itself.

Figure 4:
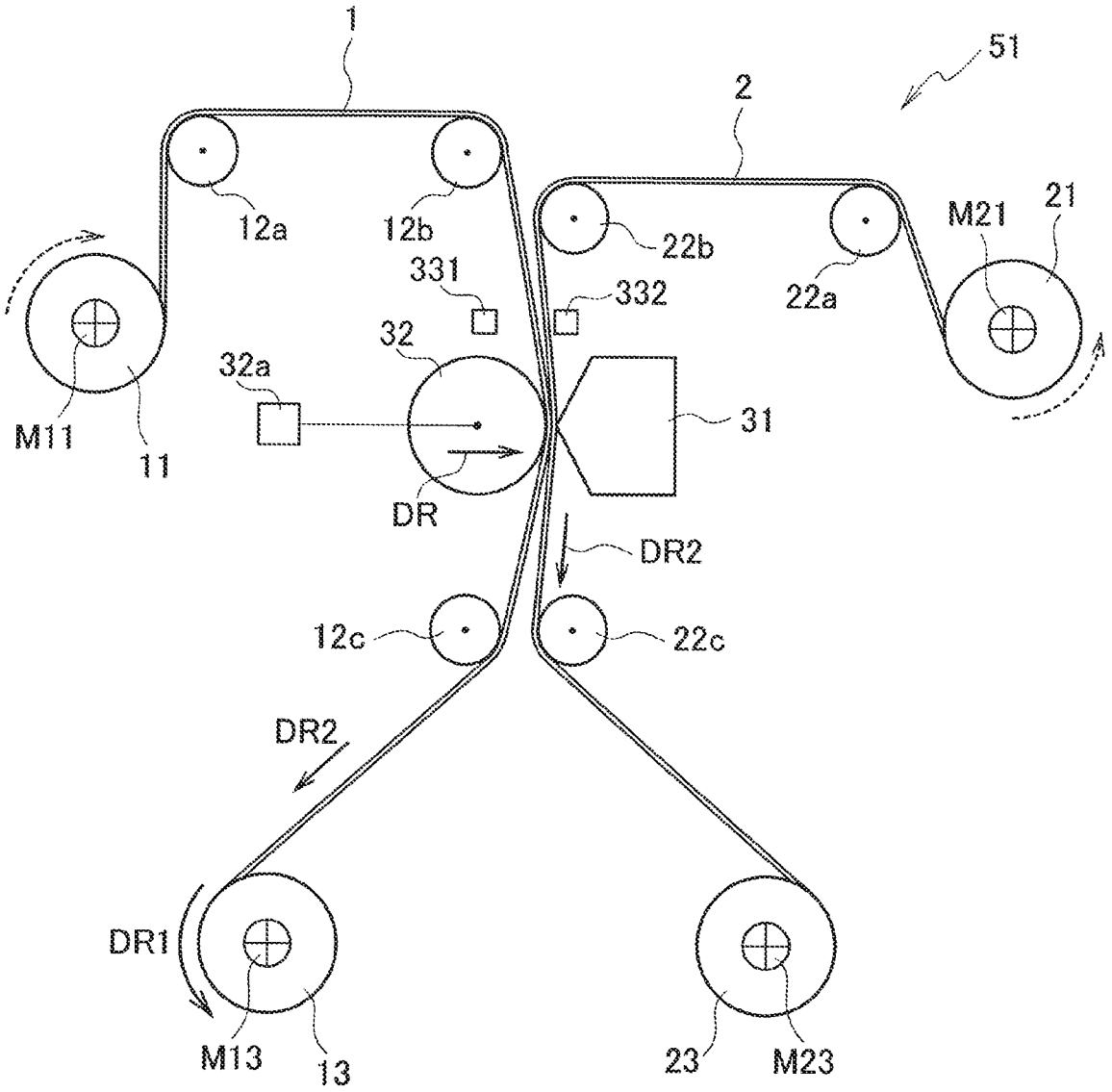
FIG. 4 is a first operation diagram for describing a thermal transfer operation and a peeling operation in the thermal transfer apparatus 51.

By an operation of a platen roller driver 32*a*, the platen roller 32 moves between a standby position of being spaced leftward apart from the transfer target film 1, the standby position being shown in FIG. 1, and an operating position of sandwiching the ink ribbon 2 and the transfer target film 1 between the thermal head 31 and the operating position itself, and elastically pressing the ink ribbon 2 and the transfer target film 1 as shown in FIG. 4.

In the film conveying system 511, in the longitudinal direction of the transfer target film 1, there is disposed a film sensor 331 for detecting, by light or the like, the above markers (not illustrated) added at a predetermined pitch so as to divide the frames.

In the ribbon conveying system 512, a ribbon sensor 332 is disposed for detecting the markers 2*b* of the ink ribbon 2 by light and the like.

Figure 3:
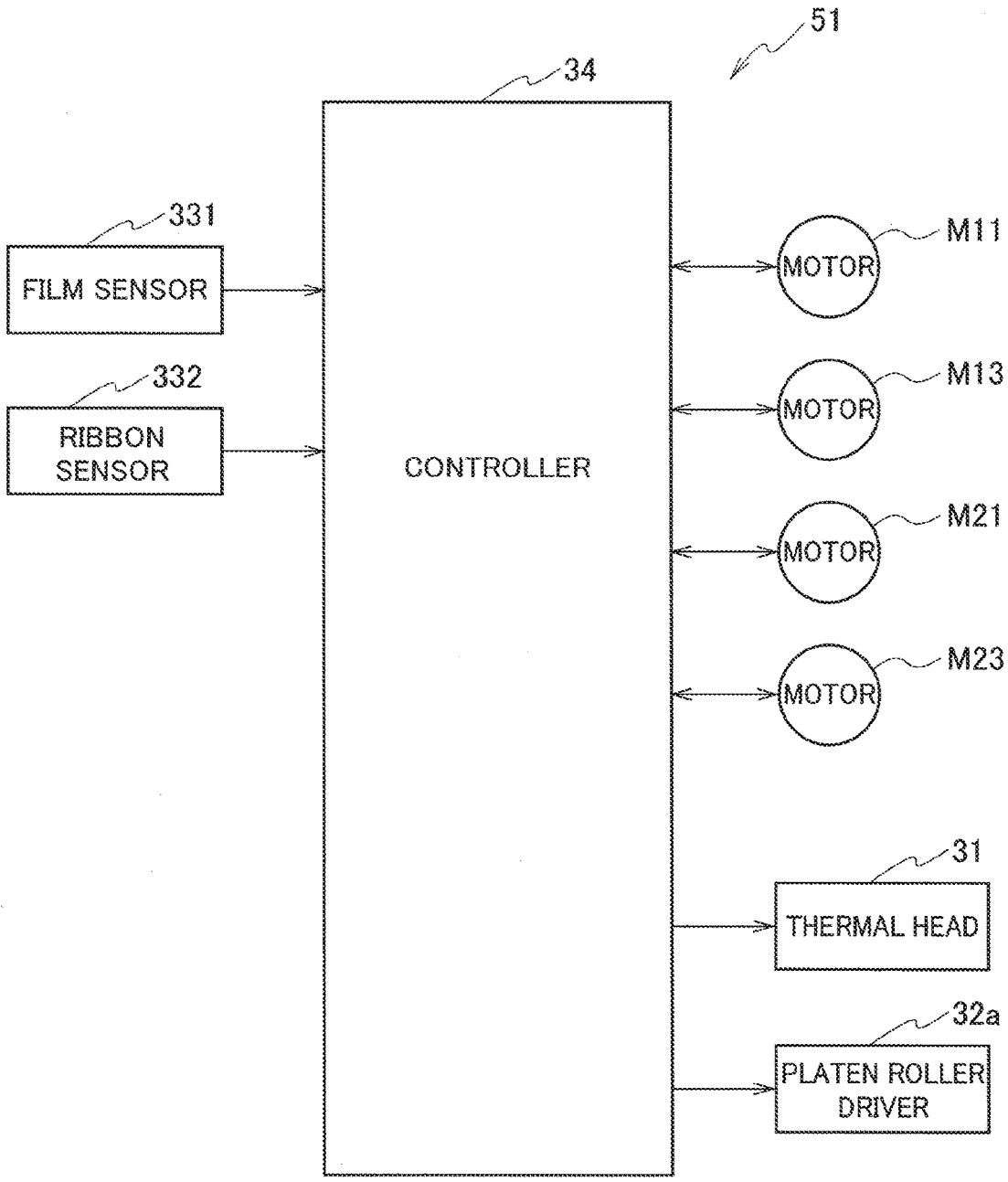
FIG. 3 is a block diagram illustrating a configuration of the thermal transfer apparatus 51.

The film sensor 331 and the ribbon sensor 332 output detection signals as to whether the markers are detected to a controller 34 shown in FIG. 3.

As illustrated in FIG. 3, the thermal transfer apparatus 51 includes the controller 34. The controller 34 controls operations of the motors M11, M13, M21, and M23 and operations of the thermal head 31 and the platen roller driver 32*a*, based on outputs of encoders (not illustrated) provided individually in the motors M11, M13, M21, and M23, outputs of the film sensor 331 and the ribbon sensor 332, and the like.

The thermal transfer apparatus 51 having the above configuration superimposes and transfers the respective inks of the three-color ink layers of the ink ribbon 2 on a transfer region of the transfer target film 1 for one frame, and can thereby form a color transfer image on the transfer region.

Moreover, the thermal transfer apparatus 51 may be made as an apparatus of a retransfer system, which includes a retransfer block TB (refer to FIG. 11) and is capable of retransferring the transfer image formed on the transfer target film 1 to a retransfer target member (such as a card C). In this case, in order to form a retransfer target region on the retransfer target member, the transfer layer 1*cd* in a predetermined range of the transfer target film 1 can be peeled by the transfer operation using the peel function layer 2P and subsequent separation of the ink ribbon 2 from the transfer target film 1 (refer to FIG. 2B).

Next, a transfer operation for one color to the one-frame transfer region in the thermal transfer apparatus 51, and a peeling operation of peeling a sticking portion HB that is a portion where the transfer target film 1 and the ink ribbon 2 stick to each other following the transfer operation will be described with reference to operation diagrams of FIG. 4 to FIG. 9 and a timing chart of FIG. 10. It is assumed that a cueing operation for the transfer is already executed by a known method.

In addition, the following operations are also applicable to operations of forming the sticking portion HB by using at least a part of the peel function layer 2P as a portion thermally adhered to the transfer layer 1*cd*, then peeling the sticking portion HB, thereby peeling a portion of the transfer layer 1*cd*, the portion corresponding to the sticking portion HB.

(S1) Time t1 to t2

As illustrated in FIG. 4, the controller 34 controls and operates the platen roller driver 32*a* to elastically press the platen roller 32 against the thermal head 31.

Following the above, the controller 34 drives the motor M13 in a winding direction (arrow DR1), and conveys the transfer target film 1 and the ink ribbon 2 in the winding direction (arrow DR2), while leaving the transfer target film 1 and the ink ribbon 2 superimposed on each other.

At this time, the motor M11 generates reverse rotation force and gives a back tension to the transfer target film 1 (broken line arrow). In FIG. 10, such giving of the back tension is indicated by broken lines.

The motor M21 is driven to give the ink ribbon 2 a back tension to an extent of not causing a sag, and the motor M23 is not operated or braked, and causes the winding reel 23 to rotate freely.

Following such conveyance indicated by arrow DR2, the superimposed transfer target film 1 and ink ribbon 2 sequentially pass and move through the position of the thermal head 31.

The controller 34 supplies the thermal head 31 with an ON/OFF signal for each dot, which is based on an image to be transferred, so that the ON/OFF signal corresponds to a dot pitch. In this way, the ink of the ink ribbon 2 is thermally transferred to the transfer layer 1*cd* of the transfer target film 1 in a selective manner, and the transfer image is formed.

Figure 5:
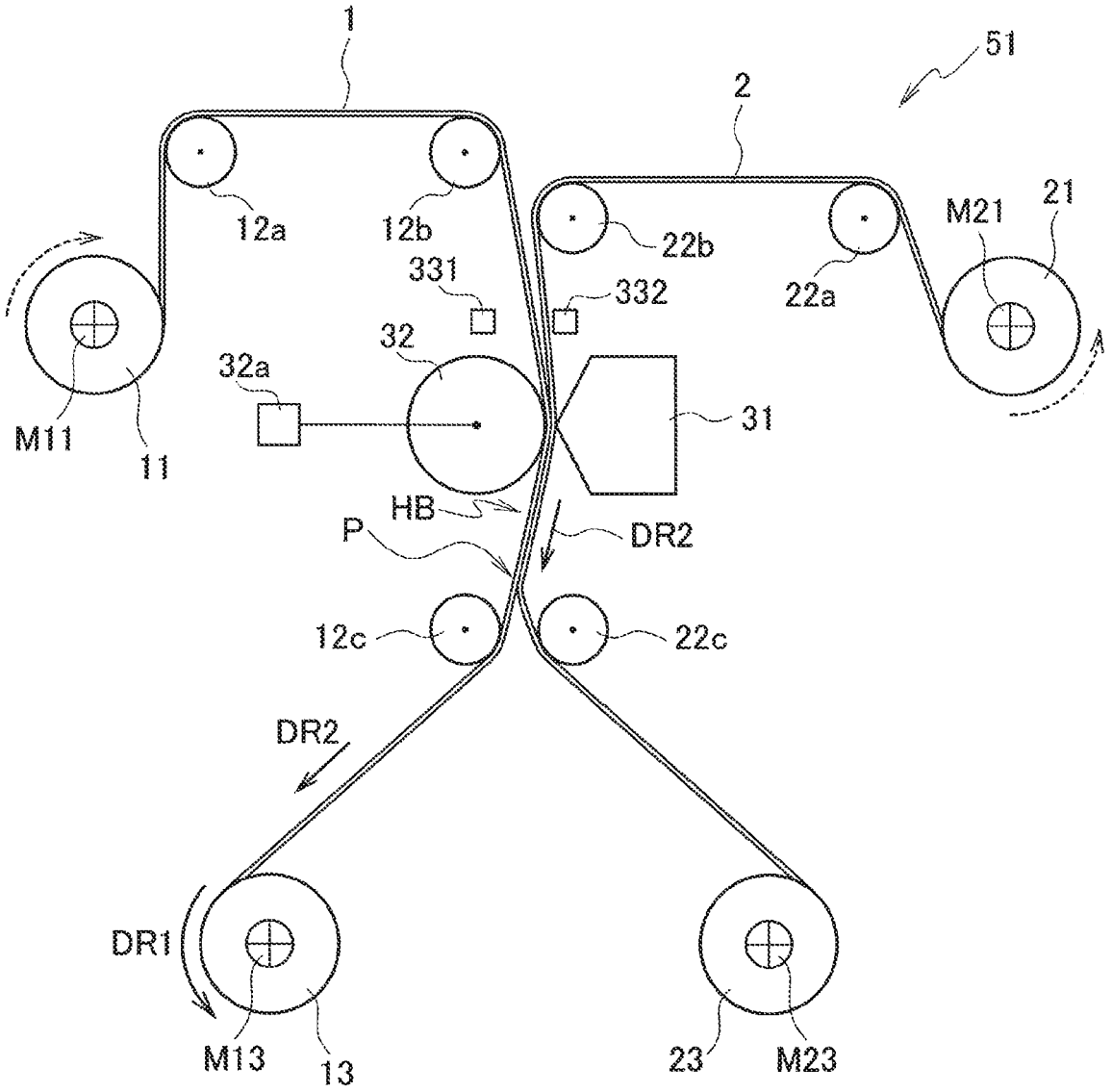
FIG. 5 is a second operation diagram for describing the thermal transfer operation and the peeling operation in the thermal transfer apparatus 51.

FIG. 5 illustrates a state in which a transfer image for one frame is being formed, that is, a state in which the transfer is being executed. The ink ribbon 2 and the transfer target film 1 are conveyed in a state of having the sticking portion HB in which upstream sides (upper sides in FIG. 5) of the ink ribbon 2 and the transfer target film 1 from a transfer starting position P stick to each other.

Figure 6:
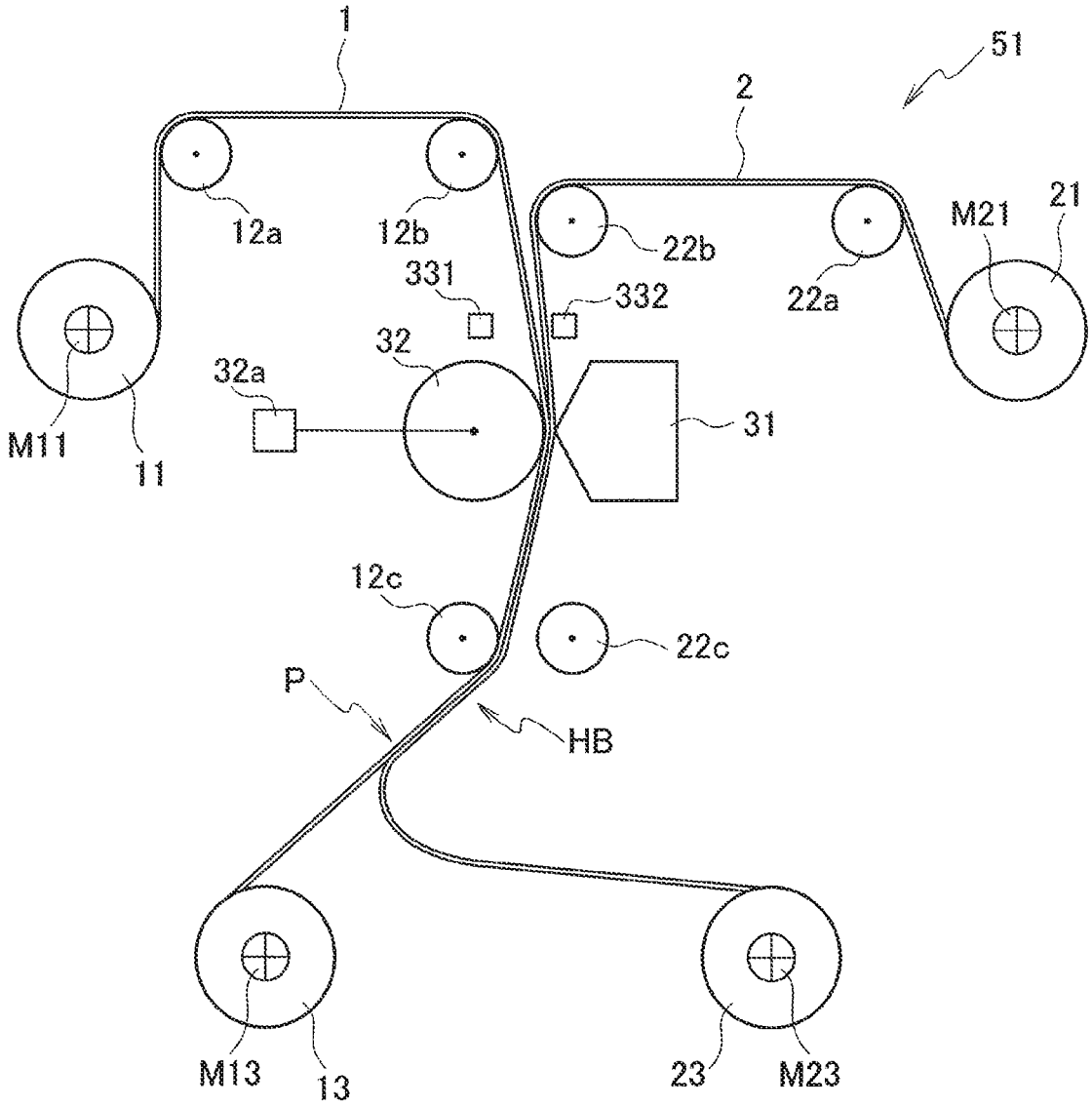
FIG. 6 is a third operation diagram for describing the thermal transfer operation and the peeling operation in the thermal transfer apparatus 51.

(S2) Time t2 to t3 (Refer to FIG. 6)

The controller 34 stops the motor M13 when the transfer for one frame is ended at time t2, and supply of the signal to the thermal head 31 is stopped. Moreover, the controller 34 controls the motors M11 and M21 to stop giving the back tension.

At this time, the transfer starting position P is located between the guide roller 12*c* and the winding reel 13, for example, as shown in FIG. 6. Moreover, the transfer target film 1 is stretched between the guide roller 12*c* and the winding reel 13, and the upstream side of the ink ribbon 2 from the transfer starting position P sticks to the transfer target film 1, and a downstream side of the ink ribbon 2 therefrom is loosened.

Figure 7:
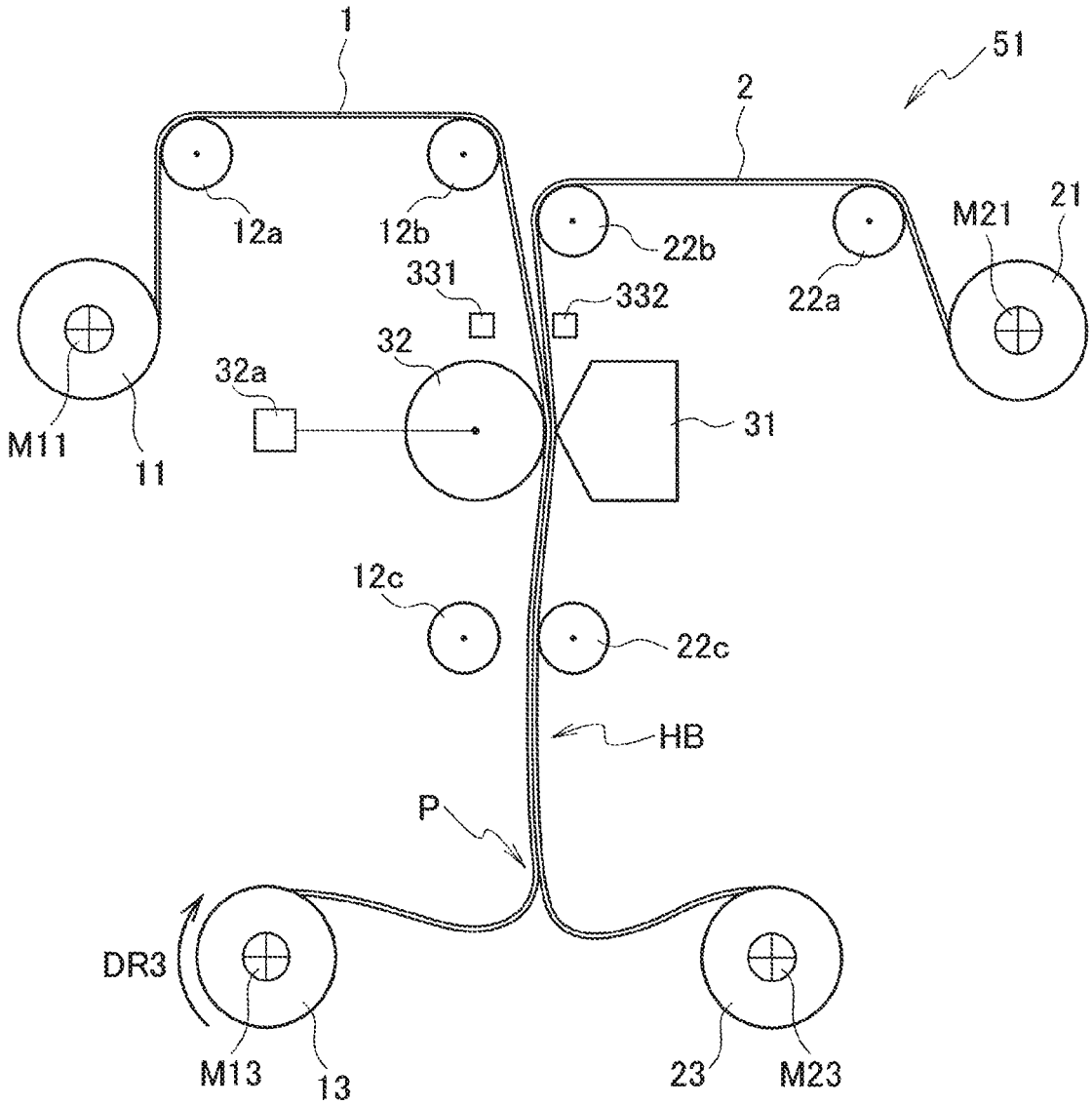
FIG. 7 is a fourth operation diagram for describing the thermal transfer operation and the peeling operation in the thermal transfer apparatus 51.

(S3) Time t3 to t4 (Refer to FIG. 7)

Subsequently, the controller 34 controls the motor M13 to rotate reversely in the direction of feeding the transfer target film 1 (arrow DR3), and to loosen the transfer target film 1.

As illustrated in FIG. 7, the motor M13 is rotated reversely until the transfer target film 1 and the ink ribbon 2, which stick to each other at the sticking portion HB, reach a substantial intermediate portion between the winding reel 13 and the winding reel 23. Thereafter, the motor M13 is not operated or braked, and causes the winding reel 23 to rotate freely.

Figure 8:
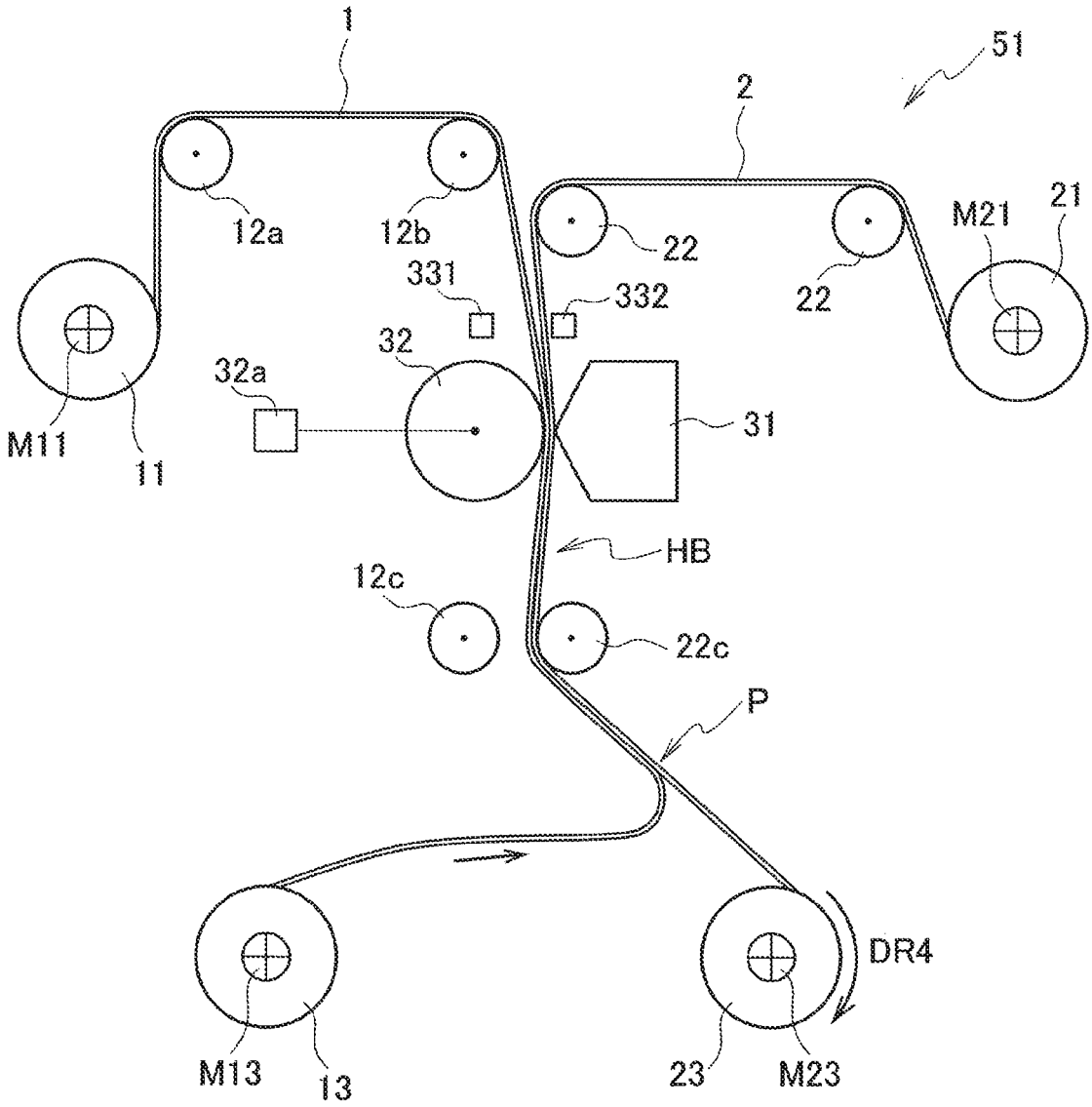
FIG. 8 is a fifth operation diagram for describing the thermal transfer operation and the peeling operation in the thermal transfer apparatus 51.

(S4) Time t4 to t5 (Refer to FIG. 8)

After causing the winding reel 23 to rotate freely, the controller 34 controls the motor M23 to rotate positively in the direction of winding up the ink ribbon 2 (arrow DR4), and stretches the downstream portion of the ink ribbon 2 from the thermal head 31. In that case, the required length of the transfer target film 1 is fed from the winding reel 13 that is freely rotating.

The ink ribbon 2 is sandwiched by the platen roller 32 at the position of the thermal head 31. Accordingly, when the ink ribbon 2 is wound up by the positive rotation of the motor M23, the ink ribbon does not slip at the position of the thermal head 31, and the downstream side thereof can be stretched.

Figure 9:
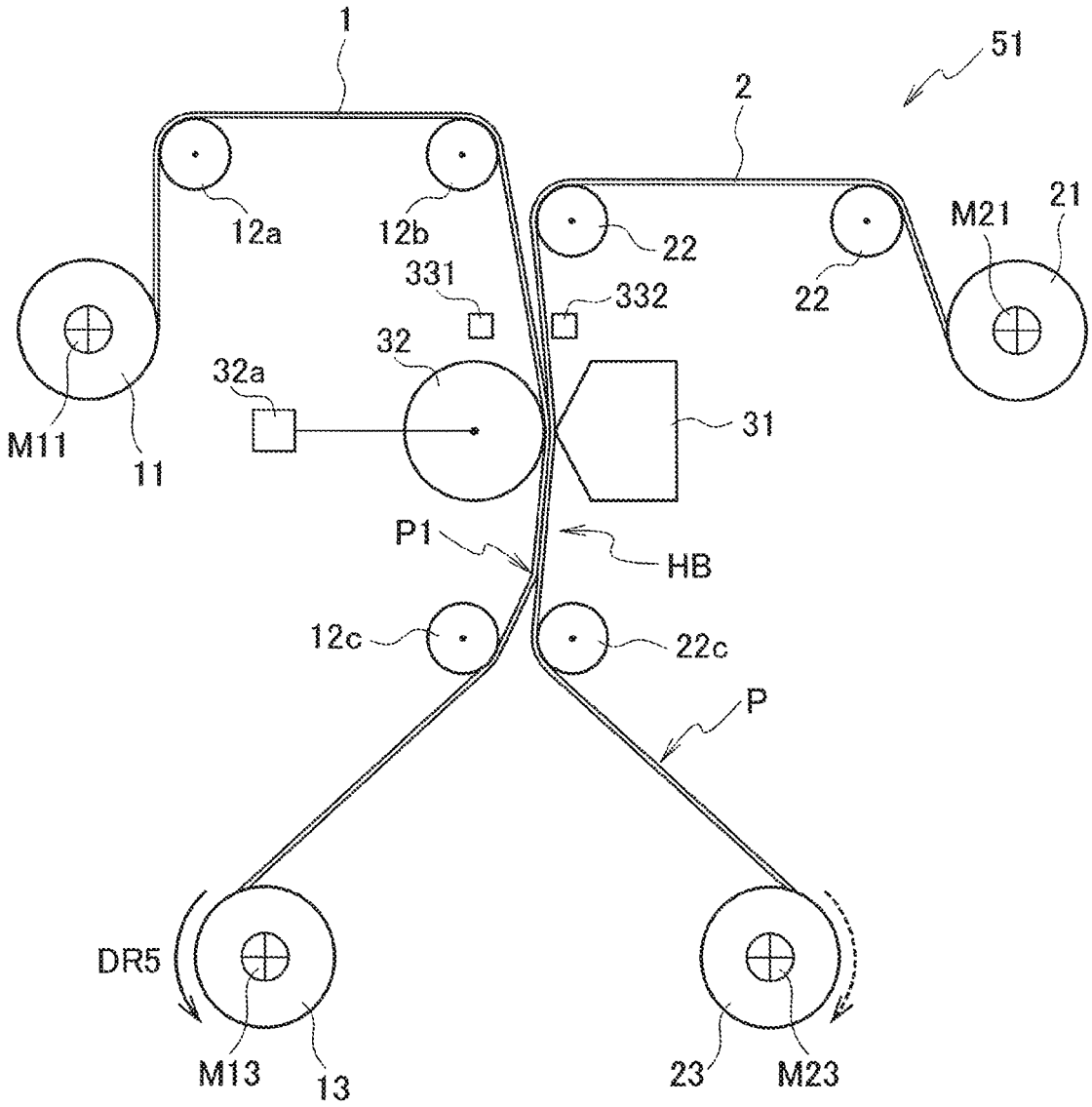
FIG. 9 is a sixth operation diagram for describing the thermal transfer operation and the peeling operation in the thermal transfer apparatus 51.

(S5) Time t5 to t6 (Refer to FIG. 9)

When the ink ribbon 2 is stretched, and torque of the motor M23 suddenly increases, then the controller 34 maintains positive rotation torque of the motor M23 to an extent where the ink ribbon 2 is not fed or loosened (broken line arrow).

Subsequently, the controller 34 positively rotates the motor M13 in the winding direction, and winds up the transfer target film 1 around the winding reel 13.

In this way, the transfer target film 1 that has stuck to the ink ribbon 2 on such an upstream side from the transfer starting position P is peeled off from the ink ribbon 2, and a sticking end portion P1 as an extreme end of the sticking portion HB moves from the transfer starting position P to the thermal head 31 side. FIG. 9 illustrates a state where the sticking end portion P1 has moved (has risen in FIG. 9) until being located between the thermal head 31 and the guide rollers 12*c* and 22*c*.

(S6) Time t6 to t7

When the motor M13 is further rotated positively, the sticking end portion P1 reaches such a pressing position by the platen roller 32 and the thermal head 31, and a state corresponding to FIG. 4 comes again, then the motor M13 is stopped, and the motor M23 is made non-operative, and the peeling operation for the transfer target film 1 and the ink ribbon 2 is ended.

(S7) Time from t7

Subsequently, the controller 34 operates the platen roller driver 32*a* to return the platen roller 32 to the standby position.

Thereafter, a cueing operation for another color of the same frame is executed, and the superimposition transfer of the color and the peeling are executed in a similar procedure.

Of course, the peeling of the transfer layer 1*cd* using the peel function layer 2P can also be executed by similar operations. That is, as shown in FIG. 2B, the heated portion of the transfer layer 1*cd* adheres to the peel function layer 2P to form the sticking portion HB, and the sticking portion HB is peeled and separated from the transfer layer 1*cd* in a state in which the transfer layer 1*cd* is adhered to the ink ribbon 2 to be peeled off.

Operation timing including an operation time of each of the motors M13 and M23 is determined by the controller 34 based on a conveyance movement for one frame, the outputs of the encoders, or is regulated by a peeling operation program created in advance.

If the above operations are executed, when the transfer target film 1 and the ink ribbon 2 are peeled off from each other, the position of the thermal head 31 is located at an unused position between the frames, and the transfer is not executed. Therefore, such malfunctions do not occur that a transfer position deviates and that a lateral stripe pattern appears on the transfer image. Moreover, in the peeling of the transfer layer 1*cd*, such a malfunction does not occur that a peeling position of the transfer layer 1*cd* deviates.

Moreover, attention is paid to mechanical properties of the transfer target film 1 and the ink ribbon 2. When the transfer is executed, the thermal transfer apparatus 51 pulls and moves only the transfer target film 1, which has a larger thickness and higher rigidity than the ink ribbon 2, by the motor M13, and the ink ribbon 2 is left free and is caused to follow the transfer target film 1 while being left stuck thereon at the sticking portion HB.

In this way, not only the peeling is prevented from affecting the transfer, but also transfer positional accuracy and transfer image quality can be maintained more highly stably by pulling only the transfer target film 1 with high rigidity.

Moreover, at the time of peeling the transfer target film 1 and the ink ribbon 2 from each other, the portion of the ink ribbon 2 on the downstream side from such a sandwiching point by the platen roller 32 and the thermal head 31 is wound up by the positive rotation operation of the motor M23, and is maintained in a state of being stretched substantially straight. Then, in such a state of being stretched straight, the transfer target film 1 having higher rigidity than the ink ribbon 2 is wound up by the motor M13, and is pulled in a direction of intersecting the ink ribbon 2.

In this way, resistance of the transfer target film 1 itself to bending is added, the peeling occurs at a relatively small peeling angle, and the peeling goes on continuously. In this way, the position of the sticking end portion P1 of the sticking portion HB moves smoothly toward the thermal head 31.

That is, the peeling of the transfer target film 1 and the ink ribbon 2 is executed stably and surely.

In other words, during the execution of the thermal transfer, the thermal transfer method to be executed by the thermal transfer apparatus 51 winds up the transfer target film 1, and causes the ink ribbon 2 to follow the transfer target film 1. Then, after the end of the thermal transfer, the ink ribbon 2 is wound up, and the transfer target film 1 is caused to follow the ink ribbon 2. Thereafter, while leaving the ink ribbon 2 stretched, the transfer target film 1 is wound up and pulled so as to be spaced apart from the ink ribbon 2.

The above thermal transfer apparatus 51 may be made as an apparatus of a retransfer system, which further includes the retransfer block TB and is capable of retransferring the transfer image formed on the transfer target film 1 to the retransfer target member (such as the card C).

Figure 11:
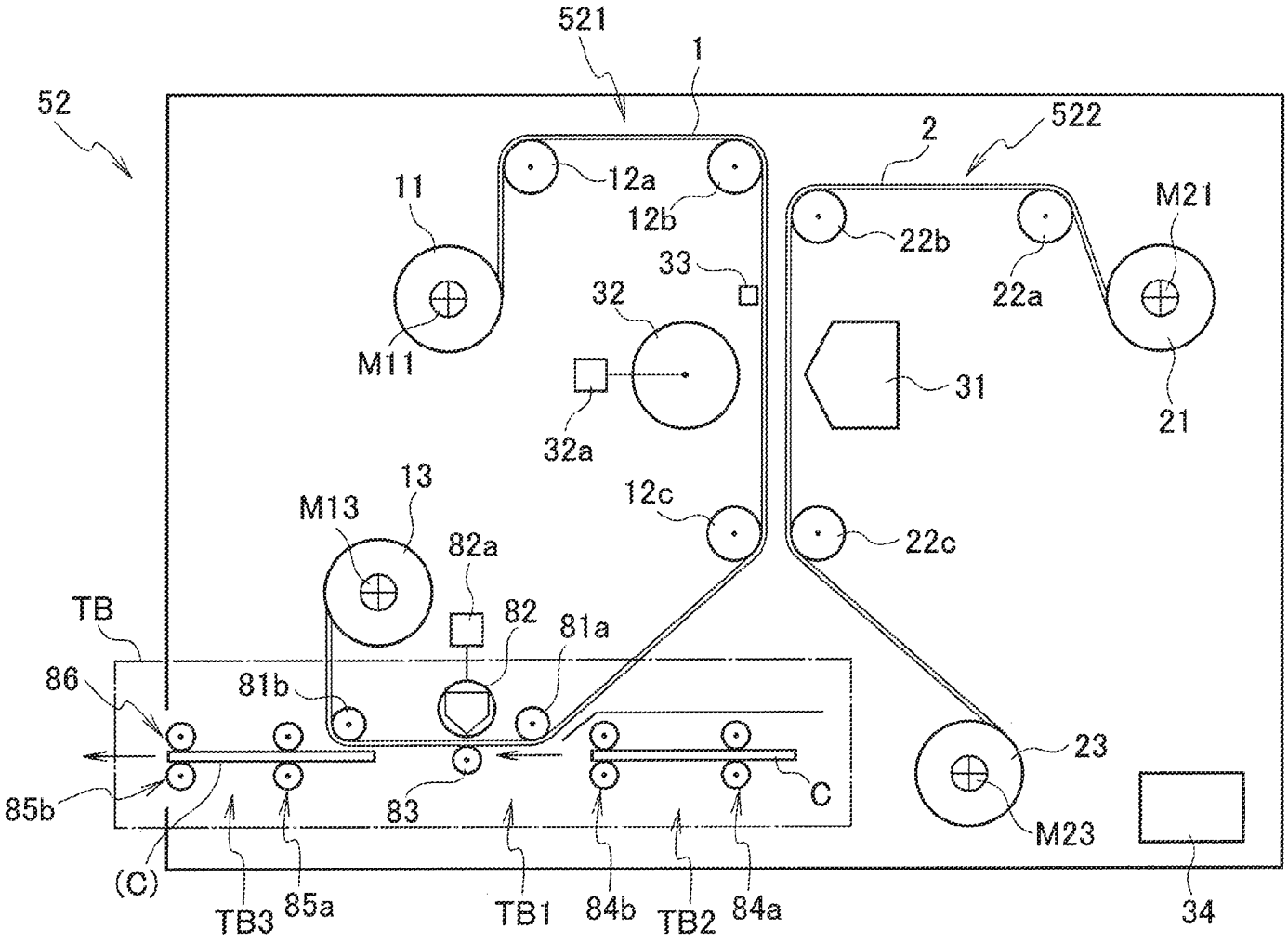
FIG. 11 is a schematic diagram illustrating a configuration of a card printer 52 as an example of a card printer according to one or more embodiments.

FIG. 11 is a diagram illustrating a card printer 52 as an example of the thermal transfer apparatus 51 of the retransfer system.

The card printer 52 includes: a film conveying system 521 corresponding to the film conveying system 511 in the thermal transfer apparatus 51; and a ribbon conveying system 522 corresponding to the ribbon conveying system 512 in the thermal transfer apparatus 51.

A ribbon conveying system 522 is the same as the ribbon conveying system 512. Unlike the film conveying system 511, the film conveying system 521 has a configuration in which the retransfer block TB is disposed between the guide roller 12*c* and the winding reel 13 in the conveying path for the transfer target film 1.

The retransfer block TB is configured by including: a retransfer unit TB1; a card supply unit TB2; and a card discharge unit TB3.

The retransfer unit TB1 includes: guide rollers 81*a* and 81*b* for guiding the conveyance of the transfer target film 1; and a set of a heat roller 82 and a press roller 83.

The heat roller 82 moves between a position spaced apart from the press roller 83 and a position of sandwiching and elastically contacting the transfer target film 1 and the card C with the press roller 83 by an operation of a heat roller driver 82*a*. Then, the transfer target film 1 and the card C are superimposed on each other and are passed between the heat roller 82 and the press roller 83, which are located at the position of elastically contacting the transfer target film 1 and the card C. The transfer image of the transfer target film 1 is retransferred to the card C by heating both thereof at this time.

The card supply unit TB2 draws the single card C from a card stocker (not illustrated), and supplies the card C to the retransfer unit TB1 by a pair of conveying rollers 84*a* and a pair of conveying rollers 84*b*.

The card discharge unit TB3 discharges the card C, which is subjected to the retransfer at the retransfer unit TB1, from a discharge port 86 by a pair of discharge rollers 85*a* and a pair of discharge rollers 85*b*.

Also in the card printer 52 as described above, similar advantageous effects are obtained by executing the above procedures of (S1) to (S7).

That is, when the peeling of the transfer target film 1 and the ink ribbon 2 is executed, the transfer is not executed. Therefore, such malfunctions do not occur that the transfer position deviates and that the lateral stripe pattern appears on the transfer image. Moreover, in the case of executing the peeling of the transfer layer 1*cd*, such a malfunction does not occur that the peeling position of the transfer layer 1*cd* deviates.

The present invention is not limited to the above-mentioned configuration and procedure, and is modifiable within the scope without departing from the scope of the present invention.

The ink ribbon 2 does not have to include the peel function layer 2P.

Figure 10:
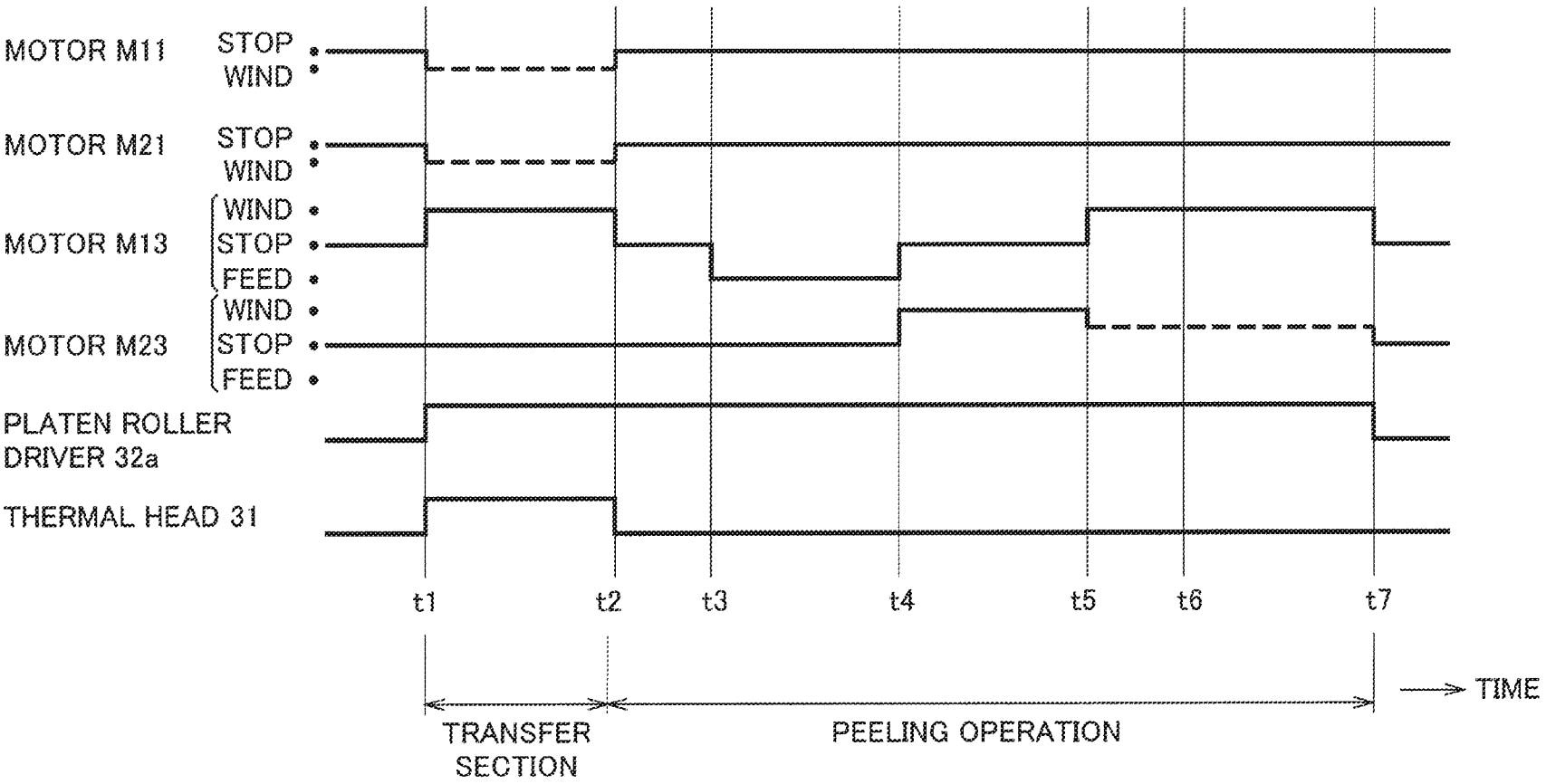
FIG. 10 is a timing chart for describing the thermal transfer operation and the peeling operation in the thermal transfer apparatus 51.

The respective time intervals on the axis of abscissas in FIG. 10 do not correspond to actual time periods of the transfer operation and the peeling operation. Desirably, a speed in the peeling operation section (time t2 to time t7) is made larger (faster) than a conveying speed of the transfer target film 1 and the ink ribbon 2 in the transfer operation section (time t1 to time t2), whereby efficiency of the whole of the transfer operation and the peeling operation is improved.

The thermal head 31 and the platen roller 32 are not limited to those as mentioned above, in which the platen roller 32 leaves and contacts the thermal head 31, and may be ones in which the thermal head 31 leaves and contacts the platen roller 32, or may be ones in which both of them move. That is, the thermal head 31 and the platen roller 32 only need to leave and contact relatively each other.

What is claimed is:

1. A thermal transfer method comprising:

moving a superimposed transfer target film and ink ribbon while sandwiching the transfer target film and the ink ribbon by a thermal head and a platen roller, and during execution of a thermal transfer of thermally transferring ink of the ink ribbon to a transfer layer of the transfer target film by heat of the thermal head, pulling and moving the transfer target film while leaving a sticking portion in which the ink ribbon sticks to the transfer target film by the heat;

after the thermal transfer is ended, stopping moving the transfer target film and enabling the transfer target film to be loosened, winding up and stretching a downstream portion of the ink ribbon from the thermal head while leaving the sticking portion sticking to the transfer target film; and while leaving the downstream portion of the ink ribbon stretched, winding up a downstream portion of the transfer target film from the thermal head, and peeling the sticking portion.

2. The thermal transfer method according to claim 1, wherein the ink ribbon comprises a peel function layer thermally adhering to the transfer layer, the thermal transfer method further comprising thermally adhering the peel function layer to the transfer layer by the heat of the thermal head, and forming a portion where the peel function layer and the transfer layer thermally adhere to each other as the sticking portion.

3. A thermal transfer apparatus comprising:

a thermal head and a platen roller which leave and contact relatively each other by operations of a driver;

a first motor and a second motor for winding up respectively a transfer target film and an ink ribbon, the transfer target film and the ink ribbon being hung over to be directly opposed to each other between the thermal head and the platen roller; and a controller for controlling operations of the driver and the first and second motors, and executing a thermal transfer operation of thermally transferring ink of the ink ribbon to a transfer layer of the transfer target film by heat of the thermal head, wherein the controller performs control:

while operating the driver and sandwiching the transfer target film and the ink ribbon between the thermal head and the platen roller, to drive the first motor, to wind up the transfer target film while causing the ink ribbon to follow the transfer target film in a state of being provided with a sticking portion in which the ink ribbon sticks by heat, after the thermal transfer, to operate the second motor, to cause a downstream portion of the ink ribbon from the thermal head to follow the transfer target film sticking to the ink ribbon at the sticking portion, and to stretch the downstream portion of the ink ribbon; and thereafter, while leaving the ink ribbon stretched, to drive the first motor to wind up a downstream portion of the transfer target film from the thermal head, and to peel the sticking portion.

4. The thermal transfer apparatus according to claim 3, wherein the ink ribbon comprises a peel function layer that thermally adheres to the transfer layer, and the controller executes a thermally adhering operation of thermally adhering the peel function layer to the transfer layer and forming the sticking portion.

5. The thermal transfer apparatus according to claim 3, further comprising a retransfer block for retransferring a transfer image to a card, the transfer image being formed by thermally transferring the ink to the transfer target film.

* * * * *